United States Patent [19]

Siblik

[11] 4,413,850

[45] Nov. 8, 1983

[54] DRUM LOCK MECHANISM

[76] Inventor: Allen D. Siblik, 2409 Valley Dr., Lindenhurst, Ill. 60046

[21] Appl. No.: 370,179

[22] Filed: Apr. 21, 1982

[51] Int. Cl.[3] ..... E05C 19/08

[52] U.S. Cl. ..... 292/256.69

[58] Field of Search ..... 292/256.69, 113, 247

[56] References Cited

U.S. PATENT DOCUMENTS

| | | | |
|---|---|---|---|
| 2,049,848 | 8/1936 | Lockhart | 292/256.69 |
| 2,108,407 | 2/1938 | Lockhart | 292/256.69 |
| 2,194,162 | 3/1940 | Conner | 292/256.69 |
| 3,339,961 | 9/1967 | Schaefer | 292/256.69 |
| 3,964,774 | 6/1976 | Wollin et al. | 292/256.69 X |

*Primary Examiner*—Richard E. Moore

*Attorney, Agent, or Firm*—McCaleb, Lucas & Brugman

[57] ABSTRACT

A lever operated mechanism for opening and closing a split clamp ring used to secure a cover over the open end of cylindrical storage drums or barrels is disclosed in which the actuating lever is pivotally connected to one end of the ring and joined to the opposite end thereof by an intervening articulated link movable along an elongated opening extending laterally through the actuating lever to present a multi-position interlink between the ring ends productive of variable mechanical advantage which increases as the ring ends approach one another. The actuating lever also carries a pivotal latch adapted to move through the elongated opening therein for purposes of securing the actuating lever to the ring and thereby preventing ring opening operation of such lever. In a modified version deformable latch means move through the lever opening to hold the same against ring opening operation.

3 Claims, 8 Drawing Figures

DRUM LOCK MECHANISM

This invention relates to lever operated mechanisms for opening and closing a split metal clamp ring and more particularly to improvements in such lever operated mechanisms embodying means for locking the mechanism in ring closing position.

Due to their relative low cost, light weight and simplicity of structure, cylindrical containers or drums of fiber board or reinforced fiber glass are widely used for storing and shipping granulated materials, such as chemicals, detergents and like items. Containers of this type usually have a removable disk-like cover head adapted to interfit with a reinforcing rim about the open end of the container and a split clamping ring or band for holding the cover over the rim and open end of the container. Typically such a split clamping ring has a lever operated mechanism mounted between its ends for expanding or contracting the ring to facilitate connection and disconnection of the cover with the rim and open end of the container. In order to insure security of the closed container during shipment, it is highly desirable to provide some type of means for locking the split ring in its closed or clamped position to prevent unwanted removal or loss of the cover.

While there have been various developments of such locking devices and mechanisms in the past, the need still exists for an improved, simplified and dependably operable device for operating the clamping ring and positively securing the same in closed position.

In brief, the present invention contemplates an improved lever operated mechanism for contracting and expanding a split ring clamp characterized by an articulated linkage connection between the actuating lever and the ring ends and productive of a variable mechanical advantage increasing as the ring clamp approaches a closed position. A simplified locking means capable of moving laterally through an opening in the actuating lever is used for securing the latter positively to the clamp ring whereby to prevent unwanted ring opening movement.

It is a principal object of this invention to provide an improved lever operated mechanism for opening and closing a split clamp ring which incorporates means for locking the clamp ring in closed position.

It is another object of this invention to provide an improved clamp ring operating mechanism, as set out in the above object, which embodies articulated linkage means productive of a mechanical advantage which assists the user in closing the clamp ring.

It is another object of this invention to provide an improved lever operated mechanism for opening and closing a split clamp ring which employs a pivotally movable lever of the second class and latch means capable of securing the actuating lever against ring opening operation.

Still another important object of this invention is to provide an improved lever operated mechanism for opening and closing split clamp rings used with drum head covers and the like, which is economical to produce and dependable in its operational characteristics.

Having described this invention, the above and further objects, features and advantages thereof will appear from the following detailed description of a preferred and modified version thereof illustrated in the accompanying drawings and representing the best mode presently contemplated for enabling those of skill in this art to practice this invention.

IN THE DRAWINGS

DESCRIPTION OF THE PREFERRED EMBODIMENT

Figure 1:
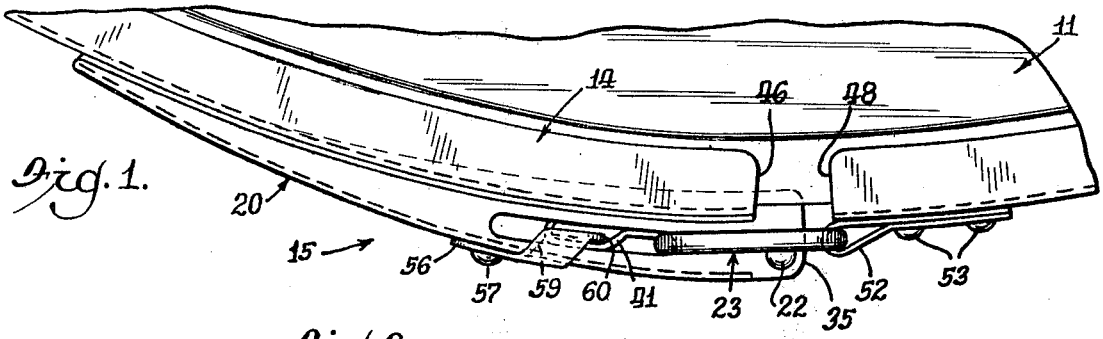
FIG. 1 is a partial top plan view of a drum head cover and clamp ring equipped with an operating mechanism of this invention.

Turning now to the particulars of the preferred embodiment, illustrative of this invention, attention is directed to FIGS. 1 through 4 of the drawings. As there shown, a conventional cylindrical storage drum 10 is provided with a removable cover 11 made of metal, plastic, fibre board, etc. which fits over a metal reinforcing rim 13 fitted about the open upper end of the drum. A split metal clamp ring 14 is used to secure the cover over the periphery of the reinforcing rim member in a conventional manner. The split ring 14 in turn is equipped with an improved lever operating mechanism 15 according to this invention for circumferentially expanding and retracting the ring 14 so as to release and lock the cover in position as the case may be.

Figure 4:
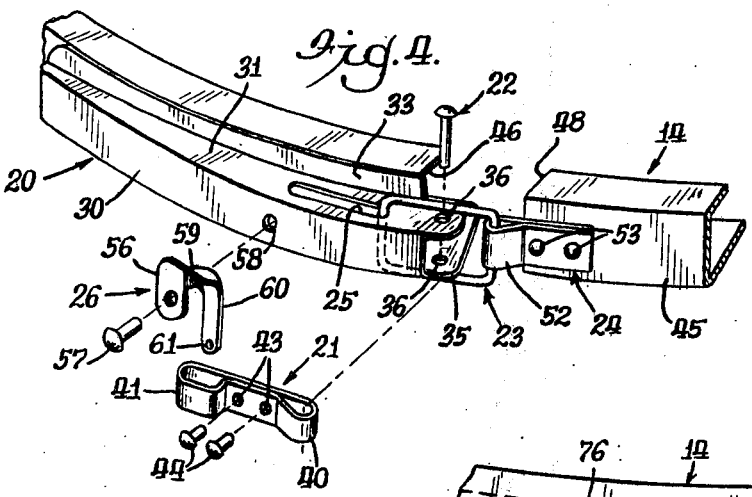
FIG. 4 is a partial exploded perspective view of the clamp ring and operating mechanism set out in FIGS. 1 through 3.

As best shown in FIG. 4 of the drawings, mechanism 15 comprises an elongated operating lever 20 which is pivotally anchored at one end to an adjacent end of the split metal ring by means of a lever strap 21 and pivot or fulcrum pin 22. The operating lever 20 also is articulately connected to the other end of the locking ring 14 by means of an intervening linkage 23 which is pivotally joined to one end of a link strap 24 mounted on the clamp ring 14. Linkage 23 has sliding operational engagement with the lever 20 via a pair of elongated openings 25, 25 located intermediate the ends of the lever. A latch means 26 is provided to maintain the ring 14 in closed position. Thus, the mechanism 15 bridges the separable ends of the split metal clamp ring 14 and serves, as previously noted, to radially expand and contract ring 14 for purposes of releasing or clamping the cover 11 over the open upper end of the drum 10.

Figure 3:
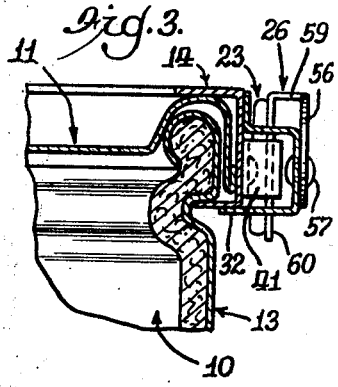
FIG. 3 is a cross-sectional view taken substantially along vantage line 3—3 of FIG. 2 and looking in the direction of the arrows thereon.

Operating lever 20 as best seen from FIG. 4, comprises a curvilinear backwall 30 flanked by right angularly related flange walls 31, 32 to formulate a generally U-shaped cross section (see FIG. 3). Each of the flange walls 31, 32 has a tapered plan configuration gradually decreasing from the leading end of the lever 20 toward the trailing or outer free end thereof. Flange wall 31 is also provided with an upstanding flange lip 33 curved to match the circumference of the drum and ring 14 whereby it abuttingly engages the outer face of the locking ring in the closed position of the operating lever. Flange wall 32, on the other hand, lies parallel to the flange wall 31 and preferably is of slightly greater lateral dimension throughout so as to extend beneath the locking ring 14 in the closed position of lever 20 as illustrated in FIG. 3. While this is a preferred construction of the lever, the same may take other forms and shapes including the elimination of the extension of the flange wall 32 beneath the locking ring as described.

Importantly each of the flange walls 31 and 32 has an elongated slotted opening 25 which is linear in formation and disposed intermediate the ends of the operating lever 20 although closer to the leading end thereof, which is pivotally joined to the locking ring, than to its opposite or free trailing end, as best shown in FIGS. 1 and 4. It will be recognized that the slotted openings 25, 25 in the two flange walls 31 and 32 are in superposed registration to provide a passageway through the operating lever 20. In addition to the structure of the operating lever as described, each of the flange walls 31 and 32 thereof has a terminal end portion comprising a mounting ear 35; the two mounting ears 35, 35 so provided lying in parallel spaced superposed opposition to one another with each having a central opening 36 receptive of the connective fulcrum pivot pin 22 therethrough. Further, the outer end of the lever 20 is adapted to receive one end of the lever strap 21 between the spaced ears 35, 35 for passage of the pin 22 therethrough; such pin being riveted over after passage through the ears 35, 35 and strap 21.

As best shown in FIG. 4 of the drawings, the lever strap 21 is formed as an elongated metal strap member having loop end portions 40, 41 formed at its opposite ends and a double wall portion 42 intermediate such loop portions. The medial portion 42 is provided with a pair of spaced openings 43, 43 receptive of a pair of rivets 44, 44 whereby the strap is secured to the outer face wall 45 of the locking ring adjacent its one end 46. Loop end portion 40 is disposed for coaxial alignment with and between the openings 36, 36 in the ear portions 35, 35, as above noted, so that pin 22 may pass through such loop 40 and ear portions for pivotally joining one end of the lever to one end of the lever strap 21. In this manner, the one inner end of the operating lever is joined to one end of the locking ring.

For purposes of providing connection between the operating lever 20 and the other end 48 of the locking ring 14, the articulated connecting link 23 is employed. This link comprises a closed, substantially rectangular shaped metal loop or bail having one end arm portion 50 which passes through the two opposed slotted openings 25, 25 in the operating lever (see FIG. 2) and an opposite end arm portion 51 which passes through a loop end portion 52 of the link strap 24; the latter being constructed essentially identical to the lever strap 21 except that only one end has a looped formation (see FIG. 4). The link strap 24 is, as best shown in FIG. 4, affixed adjacent the end portion 48 of the clamping ring by a pair of rivets 53, 53 which pass through strap 24 and the facewall 45 of the split ring 14.

Figure 2:
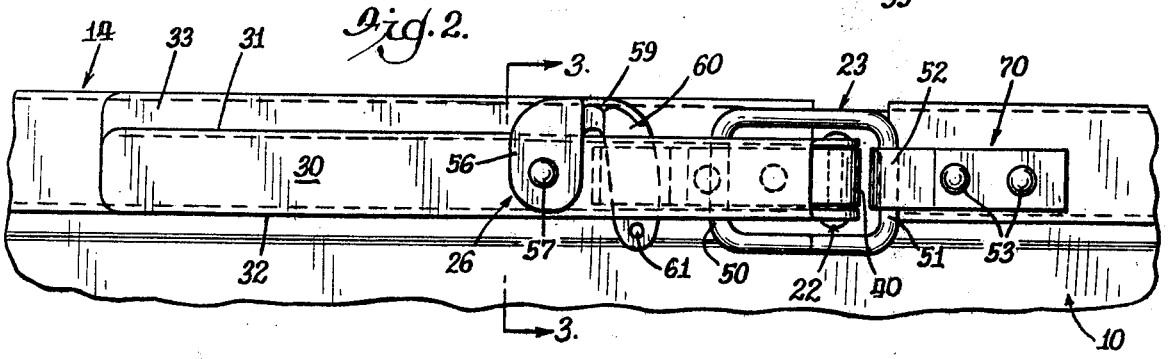
FIG. 2 is an elevational view of the assembly illustrated in FIG. 1.

From the description thus far, it will be recognized that the operating lever 20 constitutes a lever of the second class, fulcrumed about its one inner end which is adjoined to one end 46 of the clamp ring and is joined intermediate its ends, by the articulated linkage means 23, to the other end 48 of the clamping ring. This provides a sliding connection, via the elongated openings 25, between the operating lever and the articulated linkage means. With this arrangement, the linkage means 23 is slidably movable along the slotted openings 25 as the operating lever 20 is swung about its fulcrum formed by pin 22, thereby providing a multiple advantage lever arrangement in which the load transmitted to the lever via link 23 is translated to the operating lever at various positions along the slotted openings 25, i.e. at various positions medially of the length of the operating lever. Further, it will be noted that as the operating lever approaches a ring closing position, as illustrated in FIGS. 1 and 2 for example, the end arm portion 50 of the articulated link 23 approaches one end of the slotted openings 25, 25 nearest the fulcrum pin 22, thereby increasing the effective lever arm and mechanical advantage for the operating lever 20. Thus as the load increases on the operating lever its mechanical advantage likewise increases making it easier for the user to close the locking ring. In a similiar vein, maximum mechanical advantage is afforded to the operating lever during the ring opening operation particularly at the initiation of the ring opening operation to ease the burden of unclamping the ring 14.

In order to secure the clamping ring in its closed position as illustrated in FIGS. 1 and 2, and to avoid any unwanted or accidental release of the cover 11 from the drum, suitable latch means are provided for securing the operating lever against ring opening movement. To this end, the preferred form of latch means comprises the pivotally movable member 26, best illustrated in FIGS. 2 and 4 of the drawings. As there shown, the latch 26 is formed with a planar mounting portion 56 having an opening therethrough for reception of a fastening rivet 57 whereby such portion may be affixed to the outer wall 30 of the operating lever; opening 58 therethrough providing passage of rivet 57. Formed integrally with the upper end of the mounting portion 56 is a rearwardly extending angular wall portion 59 having a planar latching finger 60 depending from its rearward edge; finger 60 being provided with an opening 61 for reception of a shipping seal in a conventional manner (see FIG. 2). In order to secure the operating lever 20 in its ring closing position, it is necessary to swing the latch means 26 about its pivot center as provided by rivet means 57, whereby the depending finger portion 60 thereof enters the uppermost slotted opening 25, passes downwardly through the end loop portion 41 of the lever strap 21 and through the second slotted opening 25 formed in the bottom wall 32 of the lever. In this manner, the operating lever 20 is secured to the clamping ring via the looped end portion of the strap 21 and is thus positively restrained against ring opening operation until the latch means 26 is withdrawn from the loop portion 41. It will be recognized that the wall portion 59 provides means for gripping or prying the latch to unlock the lever 20.

While the foregoing description sets forth the features of what is considered to be the preferred form of this invention, as presently known, a modified version thereof is also illustrated in FIGS. 5 through 8 of the drawings, as will now be described.

Figure 5:
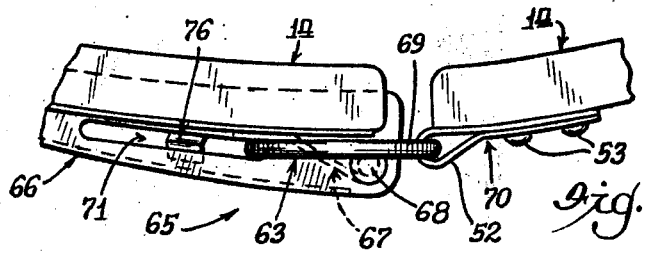
FIG. 5 is a partial plan view, similar to FIG. 1, of a modified assembly employing a modified locking means for securing the operating mechanism against ring opening operation.
Figure 6:
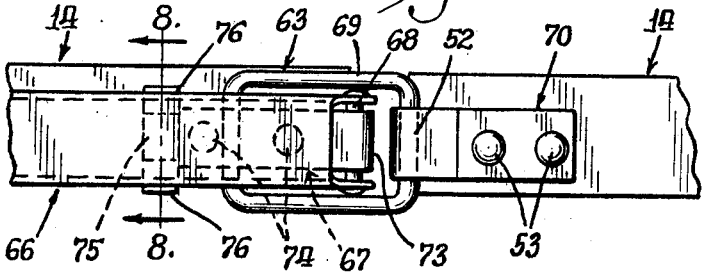
FIG. 6 is a front elevation of the modified assembly shown in FIG. 5.

As will be recognized from FIGS. 5 and 6, the lever operated mechanism indicated generally at 65, comprises an operating lever 66, joined to one end of the ring 14 by means of a lever strap 67 and a fulcrum connecting pin 68. An articulated link means 69 is pivotally joined to one looped end of a link strap 70, fixed to the other end of the clamping ring and is articulately joined to the operating lever via a pair of registeringly aligned slotted openings 71, 71, all as in the assembly 15 described hereinabove. It will be recognized that members 66 through 70 of assembly 65 are substantially identical to the corresponding members for the described assembly 15, with the exception of the lever strap member 67, as will now be described in detail.

Figure 7:
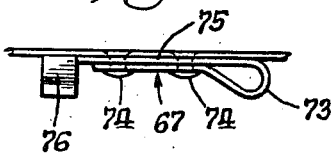
FIG. 7 is a top plan view of the modified locking means embodied in the assembly of FIG. 5.
Figure 8:
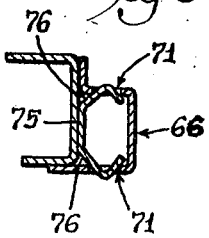
FIG. 8 is a cross-sectional view taken substantially along vantage 8—8 of FIG. 6 and looking in the direction of the arrows thereon.

As best shown in FIGS. 7 and 8, the modified strap member 67 is formed as a looped over metal strap having a single loop end portion 73 receptive of the fulcrum pin 68; the same being affixed to the locking ring 14 as by a pair of spaced rivets 74, 74 passing through a double thickness body portion 75 thereof. The opposite end of the strap member 67 is distinguished by a pair of outwardly extending separated arms 76, 76, each with a substantially right angular bend therein and each extending angularly from the plane of the body portion 75 thereof. Strap 67 is further distinguished from the strap 21 utilized in assembly 15, by virtue of its construction from spring metal, such as phosphor bronze or spring steel, whereby the extending arm portion 76, 76 at its one end are resiliently deformable toward and away from one another for engagement with lever 66 to provide an alternate latching means, as will now be described.

As will be understood from FIGS. 6 and 8 of the drawings, when the operating lever 66 is positioned in its ring closing position against the outer wall of the locking ring as illustrated, the resilient arm portions 76, 76 are disposed opposite and project into the two slotted openings 71, 71 formed through the lever flange walls. This serves to removably retain the operating lever in its ring closing position in accordance with that objective of this invention.

It is to be understood that the operating characteristics of the modified operating mechanism 65 are in general identical to that of assembly 15 hereinabove described in that the lever 66 is articulately joined to one end of the locking ring and pivotally joined to the other. The articulate linkage 69 and its connection with the elongated openings 71 of the lever constitute a multiposition interconnection therebetween whereby application of load to the second class lever is varied in accordance with the positioning of the link 69 along the slotted openings 71. As before, this arrangement provides an increasing mechanical advantage for the lever arm as the same approaches its ring closing position whereat the applied load is the greatest. Conversely, maximum lever advantage is immediately available to the operator for opening the ring. It also will be understood that as the lever 66 is brought to full ring closing position and engages the outer face of the locking ring, the resilient arm portions of 76, 76 of the latch means effectively secure the operating lever in its ring closing position by interengaging the slotted openings 71, 71.

From the foregoing it is believed those familiar with the art will readily recognize and appreciate the novel advancement of the improved lever operated mechanism hereinabove described over previous mechanisms for this purpose and will also understand that while the present invention has been described in association with preferred and modified embodiments thereof as set forth in the accompanying drawings, the same is susceptible to variation, modification and substitution of equivalents without departing from the scope of the invention as set forth in the following appended claims.

The embodiments of the invention in which an exclusive property or privilege is claimed are defined as follows:

1. For use with a split metal clamp ring adapted to secure a cover over the open end of a drum container, a lever operated mechanism for radially expanding and contracting the clamp ring, comprising: a second class lever having an elongated passageway intermediate its ends and extending laterally therethrough, fulcrum means pivotally securing one end of said lever to one end of the clamp ring, articulated linkage means slidably connected to said lever via said elongated passageway therein, means pivotally anchoring said linkage means to the other end of the clamp ring whereby said linkage means bridges the split between the ends of the clamp ring so that pivotal movement of said lever serves to move said linkage means along said elongated passageway; movement of said lever to effect contraction of the clamp ring causing said linkage means to move toward said fulcrum means as the load on said lever increases to correspondingly increase the mechanical advantage of said second class lever, and latch means movable through said elongated passageway when said lever is moved to a position for closing the clamp ring; said latch means also interlocking with the clamp ring to prevent movement of said lever in a ring opening direction until released therefrom.

2. The invention of claim 1, wherein said latch means is pivotally mounted on said lever and comprises an extended portion movable through said elongated passageway, and means secured to the claim ring receptive of said extended portion as the latter passes through said passageway.

3. The invention of claim 1, wherein said latch means comprises means secured to the clamp ring adjacent said lever, and resilient means engageable with said elongated passageway for retaining said lever against ring opening movement.

* * * * *

UNITED STATES PATENT AND TRADEMARK OFFICE

CERTIFICATE OF CORRECTION

PATENT NO. : 4,413,850

DATED : November 8, 1983

INVENTOR(S) : Allen D. Siblik

It is certified that error appears in the above—identified patent and that said Letters Patent is hereby corrected as shown below:

Column 6, line 45 (Claim 2, line 4), "claim" should be --clamp--

Signed and Sealed this

Tenth Day of January 1984

[SEAL]

*Attest:*

GERALD J. MOSSINGHOFF

*Attesting Officer*

*Commissioner of Patents and Trademarks*